US005690806A

United States Patent [19]

Sunderland et al.

[11] Patent Number: 5,690,806

[45] Date of Patent: Nov. 25, 1997

[54] CELL AND METHOD FOR THE RECOVERY OF METALS FROM DILUTE SOLUTIONS

[75] Inventors: John Garry Sunderland; Ian McCrady Dalrymple, both of Chester, United Kingdom

[73] Assignee: EA Technology Ltd., United Kingdom

[21] Appl. No.: 602,778

[22] PCT Filed: Sep. 6, 1994

[86] PCT No.: PCT/GB94/01929

§ 371 Date: Mar. 7, 1996

§ 102(e) Date: Mar. 7, 1996

[87] PCT Pub. No.: WO95/07375

PCT Pub. Date: Mar. 16, 1995

[30] Foreign Application Priority Data

Sep. 10, 1993 [GB] United Kingdom ..... 9318194

[51] Int. Cl.[6] ..... C25C 1/08; C25C 1/12; C25C 1/20; C25C 7/04

[52] U.S. Cl. ..... 205/560; 205/566; 205/571; 205/575; 205/587; 205/598; 205/594; 204/260; 204/269; 204/272; 204/275; 204/283; 204/284; 204/286; 204/290 F; 204/292; 204/294; 204/237

[58] Field of Search ..... 204/272, 294, 204/269, 292, 260, 275, 283, 284, 286, 290 F, 237; 205/566, 571, 575, 587, 594, 598, 560

[56] References Cited

U.S. PATENT DOCUMENTS

| | | | |
|---|---|---|---|
| Re. 34,233 | 4/1993 | Bachot et al. | 204/242 |
| 2,273,036 | 2/1942 | Heise et al. | 204/107 |
| 2,273,798 | 2/1942 | Heise et al. | 204/82 |
| 2,583,098 | 1/1952 | Heise et al. | 204/112 |
| 3,425,920 | 2/1969 | Frantzis | 204/145 |
| 3,650,925 | 3/1972 | Carlson | 204/153 |
| 3,926,751 | 12/1975 | De Nora et al. | 204/105 |
| 4,046,663 | 9/1977 | Fleet et al. | 204/280 |
| 4,046,664 | 9/1977 | Fleet et al. | 204/280 |
| 4,073,702 | 2/1978 | Fleischmann et al. | 204/59 |
| 4,108,754 | 8/1978 | Fleet et al. | 204/294 X |
| 4,108,755 | 8/1978 | Fleet et al. | 204/263 |
| 4,108,757 | 8/1978 | Fleet et al. | 204/294 |
| 4,127,458 | 11/1978 | MacGregor | 204/109 |
| 4,162,950 | 7/1979 | MacGregor | 204/149 |
| 4,226,685 | 10/1980 | Portal et al. | 204/105 |
| 4,280,884 | 7/1981 | Babb et al. | 204/109 |
| 4,292,160 | 9/1981 | Marcantonio | 204/237 |
| 4,367,127 | 1/1983 | Messing et al. | 204/272 X |
| 4,384,939 | 5/1983 | Kim et al. | 204/110 |
| 4,396,474 | 8/1983 | Astruc et al. | 205/566 X |
| 4,406,752 | 9/1983 | Weininger et al. | 205/566 |

(List continued on next page.)

FOREIGN PATENT DOCUMENTS

| | | |
|---|---|---|
| 2 579 998 | 4/1985 | France . |
| 4013884 | of 0000 | Japan . |
| 1423369 | 2/1976 | United Kingdom . |
| 1 426 736 | 3/1976 | United Kingdom . |
| 1 598 306 | 9/1982 | United Kingdom . |

*Primary Examiner*—Donald R. Valentine
*Attorney, Agent, or Firm*—Westman, Champlin & Kelly, P.A.

[57] ABSTRACT

An electrochemical cell is provided for removal of metals such as copper, lead, silver, tellurium, platinum, palladium or nickel from dilute solutions of the metal. The cell comprises a porous tubular support (18) which is provided with a cathode comprising a porous carbon fiber material (19), a current feeder (15) for the cathode, a tubular anode (12) spaced from said cathode, a current feeder (16) for the anode, the anode and the cathode being enclosed by a non-porous outer casing (11). In use the dilute solution from which the metal is to be removed is introduced into the cell through an inlet (13) and flows through the porous carbon fiber cathode to an outlet (14). The cell is useful for removing harmful metals from wastes so that they are environmentally acceptable for disposal and for recovery of valuable metals.

65 Claims, 10 Drawing Sheets

U.S. PATENT DOCUMENTS

| | | | |
|---|---|---|---|
| 4,422,917 | 12/1983 | Hayfield | 204/196 |
| 4,459,189 | 7/1984 | Vance et al. | 204/106 |
| 4,643,819 | 2/1987 | Heroguelle | 204/269 |
| 4,657,462 | 4/1987 | Hoen | 411/552 |
| 4,680,100 | 7/1987 | Morin | 204/272 X |
| 4,702,806 | 10/1987 | Miller et al. | 204/106 |
| 4,734,182 | 3/1988 | Hvistendahl | 204/290 |
| 4,762,598 | 8/1988 | Drew | 204/109 |
| 4,795,538 | 1/1989 | Caude et al. | 204/111 |
| 4,828,666 | 5/1989 | Iizuka et al. | 204/255 |
| 4,911,804 | 3/1990 | Dickson | 204/110 |
| 4,927,509 | 5/1990 | Mathur et al. | 204/83 |
| 5,080,963 | 1/1992 | Tatarchuk et al. | 428/225 |
| 5,089,097 | 2/1992 | Goto et al. | 204/109 |
| 5,149,414 | 9/1992 | Chiang et al. | 204/294 |
| 5,156,721 | 10/1992 | Whewell | 204/111 |
| 5,160,415 | 11/1992 | Kondo et al. | 204/60 |
| 5,160,419 | 11/1992 | Kageyama et al. | 204/294 |
| 5,192,411 | 3/1993 | vom Baur | 204/280 |
| 5,254,234 | 10/1993 | Solis Cortes et al. | 204/275 |
| 5,256,268 | 10/1993 | Goto et al. | 204/268 |
| 5,290,413 | 3/1994 | Bauer et al. | 204/243 |
| 5,391,433 | 2/1995 | Kawakubo et al. | 428/408 |
| 5,419,824 | 5/1995 | Weres et al. | 204/268 |
| 5,435,896 | 7/1995 | Hardee et al. | 204/247 |
| 5,464,506 | 11/1995 | Bernard et al. | 204/105 |
| 5,503,728 | 4/1996 | Kaneko et al. | 204/290 |
| 5,554,270 | 9/1996 | Bernard et al. | 205/494 |

CELL AND METHOD FOR THE RECOVERY OF METALS FROM DILUTE SOLUTIONS

This invention relates to the recovery of metals from dilute solutions.

It is well known that the electrodeposition of metals from dilute solutions requires the use of very high mass transfer cells or high surface area electrodes, the latter operating at low current densities on a real area basis. In order to realise high surface areas previous work has involved the use of mesh electrodes, toughened electrodes and metal and carbon foams. With the introduction of conducting carbon and graphite fibres of very small diameter, typically 5 to 15 microns, these fibers can be used to provide an electrode of a very high surface area to volume ratio. The inventors have now discovered that by using a cathode comprising such carbon or graphite fibers, through which the dilute solution of metal is passed, metal ions can be removed from solution, especially metal containing effluents, in a suitably engineered electrochemical cell. For example, copper can be removed from solution to levels below 1 ppm with high current efficiencies from solutions containing initially 20 ppm.

There is described in EP-A-0 129 845 (American Cyanamid Company) an electrode comprising a plurality of continous fibers, wherein each of said fibers has a thin, firmly adherent, metallic coating thereon. The disclosed electrochemical cell is a complex arrangement, and for effluent treatment simple operations are essential for the successful commercialisation of an electrochemical metal removal cell. It is a prerequisite of any cell for removing metals from dilute solutions that the cell design is simple and the cathode easy to replace. The individual cells are desirably modular so that additional cells can be added if the metal loading in a particular application is required to be increased.

Carbon fibers can be obtained in several forms e.g. papers, veils, yarn, tow, chopped or milled fibers, needled, non-woven mat and as felts. These fibers can, therefore, be made up into a variety of forms e.g. flat felts or cylinders. Many of these carbon fibers have relatively high electrical conductivities which can be optimised depending on the heat treatment applied during the production process. Typically a single filament can have a resistivity of $3.1\times10^{-3}$ to $22.6\times10^{-3}$ ohm-cm.

It is an object of the present invention to provide a simple electrochemical cell that can be used to remove metal from solutions containing up to 50 ppm.

According to the present invention there is provided an electrochemical cell for the removal of metals such as copper, lead, silver, tellurium, platinum, palladium or nickel from dilute solutions of the metal, said cell comprising a porous tubular support which is provided with a cathode comprising a porous carbon fiber material, a current feeder for the cathode, a tubular anode spaced from said cathode, a current feeder for the anode, the anode and cathode being enclosed by a non-porous outer casing, the arrangement being such that in use during electrolysis the dilute solution from which the metal is to be removed is introduced into the cell by means of an inlet and flows through the porous carbon fiber cathode and out from the cell through an outlet.

The porous support is preferably fabricated from a non-conducting substance such as porous polyethylene, an open mesh structure or an appropriate filter cloth supported on the open structure so that the flow regime required can be obtained. The support may also be a conducting material in which case it can also act as the cathode current feeder.

The combination of the support and the carbon fiber cathode in intimate contact acts to control the flow distribution of the electrolyte through the cathode. A pressure drop is inevitably created when the electrolyte passes through the porous support and cathode. In order that the pressure drop and hence the flow is regulated, the relative pore sizes of the cathode and porous support may be adjusted in different embodiments of the invention. For example, when a cathode of open structure (i.e. large pore size) is employed, a porous support with relatively small pores is required. In the case of a relatively dense cathode however a more open support material of larger pore size is sufficient. The same principle applies whether the electrolyte is flowing from the cathode outer side or the support side. The resultant even flow distribution achieved provides a steady flux of metal ions to all parts of the cathode and therefore sustains a maximum level of current for metal deposition.

Additional or alternative regulation of flow may be achieved by overwinding the tubular porous support with string before applying the cathode. By varying the tension applied to the string (described as a string filter) the pressure drop across the cathode can be adjusted as desired.

A flow rate of about 2 to about 80 litres/minute may be used with the apparatus of the invention. Preferably however, the flow rate will be about 15 to about 30 litres/minute.

Preferably the cathode is a carbon felt which is wrapped around the said porous support with at least one complete winding around the support.

Current is supplied to the cathode by means of current feeders which are preferably supported on the cathode tubular porous support. One example of the type of current feeder that may be used is stainless steel rods. Where the cathode is carbon felt, to ensure that electrical contact is maintained with the stainless steel, the carbon felt is pulled down onto the current feeder by means of, for example cable ties or similar means of fastener. Alternatively a metal strip can be employed as the current feeder. Such a strip can be either in the form of separate lengths fed from a common point or in the form of a spiral wound along the length of the carbon felt or as a mesh which produces an even current distribution throughout the cathode. Whether the current feeder is in the form of a strip, rod, spiral or mesh it is preferable for it to extend along the entire length of the electrode so as to uniformly distribute the current to the entire effective carbon surface.

It is preferable that in the case of large electrodeposition cells, the electrical resistance of the current feeders be as low as possible. This is to ensure that resistive losses which result in heating of the current feeders are minimised. Similarly, it is desirable for the current feeder selected to be corrosion resistant in the electrolyte in use.

It will be well understood by those skilled in the art that it is also highly desirable that the anode is stable under the specific conditions employed in each electrolyte composition. For example, with alkaline electrolytes it is preferable to use a nickel anode or some other suitable corrosion resistant material which is stable in alkaline conditions such as stainless steel or mild steel. With acid electrolytes it is preferable to use a suitably corrosion resistant material stable in acidic conditions, for example, a noble metal coated titanium anode.

Current feeders for the anode may be, for example, titanium rods, preferably spot welded to the anode. Alternatively, titanium bolts which extend through the non-porous outer casing of the cell and make contact with the anode can be used. In such a case the head of the bolt may be located within the cell and in contact with the active surface of the anode.

It is also preferred that the outer casing provides a support for the tubular anode which extends for substantially the full length of the tube commensurate with the length of the cathode or cathodes. The material for the casing can be chosen from U-PVC, C-PVC, ABS, polypropylene or other suitable non-porous material. The choice will depend to some extent on the electrolyte being used and hence the chemical and temperature resistance required.

Preferably the non-porous outer casing is tubular with separate, removable top and bottom end plates.

In one embodiment of this invention the cell may include two anodes, one within the tubular support but spaced therefrom and the second surrounding the cathode as described above. Since, in operation the metal may deposit preferably in the section of the cathode nearest the anode, by operating with two anodes as described it is possible to load the cathode more rapidly and uniformly throughout the volume of the cathode. This embodiment is particularly useful when low conducting electrolytes are employed. For such an embodiment it is preferable if the second anode inside the tubular support is in the form of a mesh. This acts to minimise the restriction in flow and therefore the pressure drop due to the second anode.

In another embodiment the cell of the invention may include a microporous separator, for example a polymer mesh tube, with a high open area possessing small apertures (<20 microns) located in the space between and separating the anode and the cathode. In certain applications oxygen may be produced at the anode while hydrogen is released at the cathode. For safety reasons it is desirable to substantially prevent the mixing of the oxygen gas produced at the anode and the hydrogen gas produced at the cathode. The microporous separator serves to minimise the mixing of the hydrogen and oxygen and is hence a safety feature. Support for the separator may be provided by means of perforated discs or a cage assembly supported off the porous support. The tubular separator is thus concentric with the cathode and spaced off from the cathode. The ends of the separator may be closed so encouraging the hydrogen rich solution stream to exit with the depleted metal stream via the top solution outlet of the cell. The microporous tube also acts to contain any metal that is loosely adherent to the cathode. The oxygen gas evolved from the anode may exit by a channel appropriately machined in a top plate of the cell so that the oxygen enters in the channel. A bleed pipe which extends into said channel may then be provided in the top plate. This allows gas to be bled off with electrolyte via a transmission tube at a rate commensurate with its rate of formation.

In yet another embodiment of the invention a tubular ion-exchange membrane may be located between the anode and cathode so that two separate electrolyte compartments can be realised. This enables two different electrolyte streams to be used in the two compartments. This is desirable when, for instance, metal is to be removed from a chloride containing electrolyte. In a cell without an ion-exchange membrane chlorine will be evolved at a noble metal anode. This is obviously undesirable from the safety point of view and also, as the chlorine concentration builds up in the solution the electrodeposit may redissolve. The ion-exchange membrane ensures that the chloride ion does not enter the anolyte compartment to any great extent. It enables two different electrolytes to be employed as the anolyte and the catholyte. Sodium sulphate solution is an example of a suitable anolyte for use in this embodiment. Only oxygen is then produced at the anode in this case. Seals may be provided in the top and bottom end plates to ensure that electrolyte mixing between the anolyte and catholyte compartments cannot occur.

For all the embodiments described above, it is envisaged that at least two cells can be arranged in series or in parallel in the flow path of the solution. Alternatively, a plurality of cathodes may be arranged in series or in parallel within a single unitary anode and housing. Either way it is preferable if, when in use, the electrolyte solution passes in the first cathode or cell from inside the cell through the cathode towards the anode, and passes through the second cathode in the opposite direction away from the anode.

Additional benefits can be gained by reversing the direction of the electrolyte flow in this way. In certain operational schemes, the concentration of the metal ions in solution will fall significantly while passing through the cell. This is particularly true when single pass operation is underway in cells containing two or more carbon fiber cathodes in series. Under these conditions metal is deposited to a greater extent on the first cathode where the solution concentration is relatively high and to a lesser extent on the second and subsequent cathodes. Flow reversal under these circumstances achieves a more even electrodeposited metal distribution between the cathodes by reversing the direction of the soluble metal concentration gradient within the cell. The result is increased operational efficiency and a greater metal loading capacity.

The benefit of flow reversal can also be obtained within a single cell having just one cathode by blocking the tubular support at various points so that the electrolyte solution is forced in the opposite direction and travels up through the cathode in a zig-zag fashion.

It is preferable if the upper value of metal concentration in the solution to be treated is 50 ppm. This provides that the carbon fiber electrode does not become overloaded with electrodeposited metal. The invention can be used at higher metal loadings but more frequent replacement of the cathode or dissolution of the cathodic deposit is required. Chemical or anodic dissolution can be used to remove the deposited metal from the carbon fibers which are essentially inert and are unaffected by both hydrochloric and sulphuric acids, which are examples of electrolytes that may be used for the dissolution process. The cell can be used for concentrations of >20 ppm if this is required.

The electrochemical cell may be operated as a method for final treatment of metal-bearing effluent prior to discharge of a clean waste stream with metal concentrations below the local effluent consent limits. The recovered metal value may not be a significant factor in these cases, e.g. when a mixture of metals are removed from the solution and are accordingly deposited, i.e. plated, within the cathode. Another operational use is the application of the cell in a "polishing" procedure for the output from a separate electrochemical devices such as those described in FR-2579998 or GB-1423369. Electrolysis using these cells alone cannot achieve the very low soluble metal levels which can be obtained by operation in conjunction with the electrochemical cell according to this invention. The unique properties of the cell described herein permit suitably low metal concentrations to be achieved, i.e. concentrations of less than 1 ppm for the metals mentioned above to be achieved efficiently.

The invention also provides a method of removing metals such as copper, lead, silver, tellurium, platinum, palladium or nickel from dilute solutions of the metal, which method comprises passing a dilute solution of the metal into a cell according to the invention and passing a direct current between the anode and cathode to deposit the metal on the surface of the carbon of the cathode.

In carrying out the method of the invention flow rates of dilute solution of from about 2 to about 80 litres/minute may be used although typically the flow rate used will be between about 15 and about 30 litres/minute. The current density which may be employed is preferably between about 100 and about 300 A/m$^2$. However, in certain applications, for example when operating with electrolytes of very high acidity or alkalinity a current density in excess of 300 A/m$^2$ may be needed to plate the metal on the cathode and prevent its redissolution in the electrolyte. In such applications the current density employed may be between about 300 A/m$^2$ and 800 A/m$^2$.

The invention will now be described with reference to the accompanying drawings in which.

Figure 1:
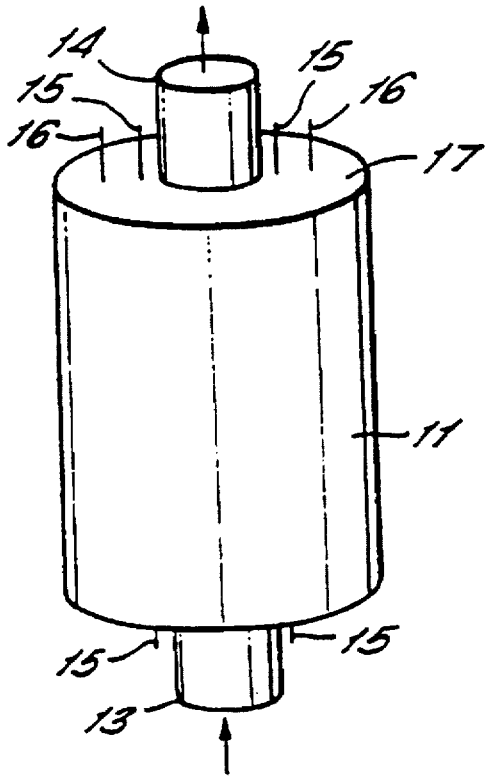
FIG. 1 shows a side view of a cell assembly in accordance with the invention.
Figure 2:
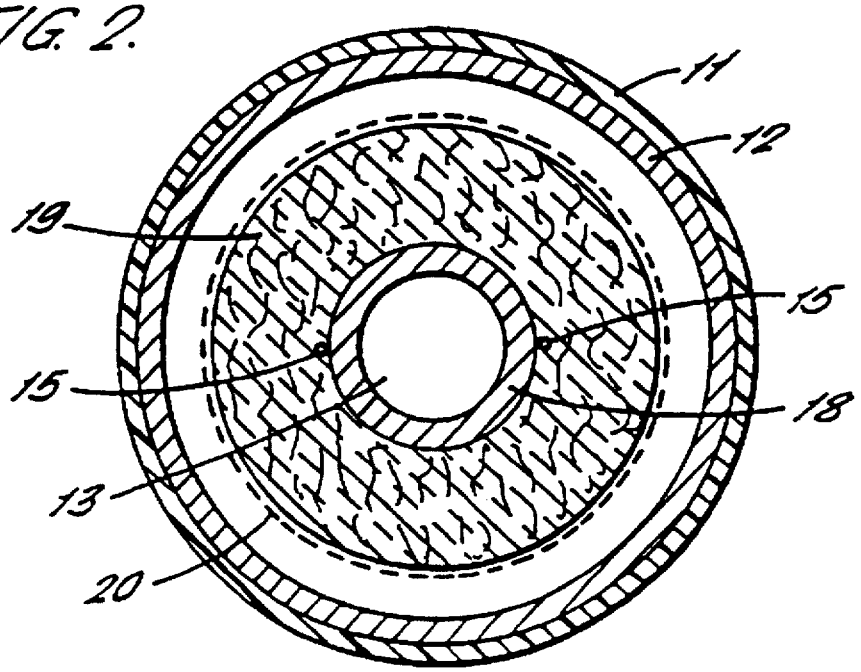
FIG. 2 shows a horizontal cross-section of the cell assembly of FIG. 1.

The electrodeposition cell shown in FIGS. 1 and 2 is a tubular design. The outer casing is tube 11 fabricated in UPVC and this provides a support for the tubular anode 12 which extends along the internal length of the tube 11. The cell has an inlet 13 and an outlet 14 for the solution to be electrolysed.

The anode is stable in the solution from which the metal is to be removed. A nickel or a noble metal coated titanium electrode may be used in alkaline electrolytes. In acid electrolytes an inert electrode, e.g. noble metal coated titanium or Ebonex, a titanium sub-oxide (this is a proprietary electrode material which has a high conductivity and excellent corrosion resistance) or, under certain conditions, lead dioxide on titanium can be used. The conditions which enable a lead dioxide on titanium anode to be used are those where the applied current density is very low and there are no organic materials present to complex with the lead which would remove lead dioxide from the surface of the titanium. The titanium substrate for the noble metal coated titanium electrode may be mesh or plate.

The current feeders to the cathode 19 are two rods 15 made of a low electrical resistance metal, such as stainless steel, diametrically opposed to each other and in intimate contact with the porous support and the cathode. They extend outside the upper and lower end plate assemblies 17 which seal the ends of tube 11. The rods 15 provide the means for making the electrical connection to the cathode. Because the electrical resistance of the carbon-fiber electrode is so much greater than that of a metal such as steel, the current feeders 15, in order to carry current to the entire effective carbon electrode surface, extend along (or through) the entire length of the electrode.

Figure 8:
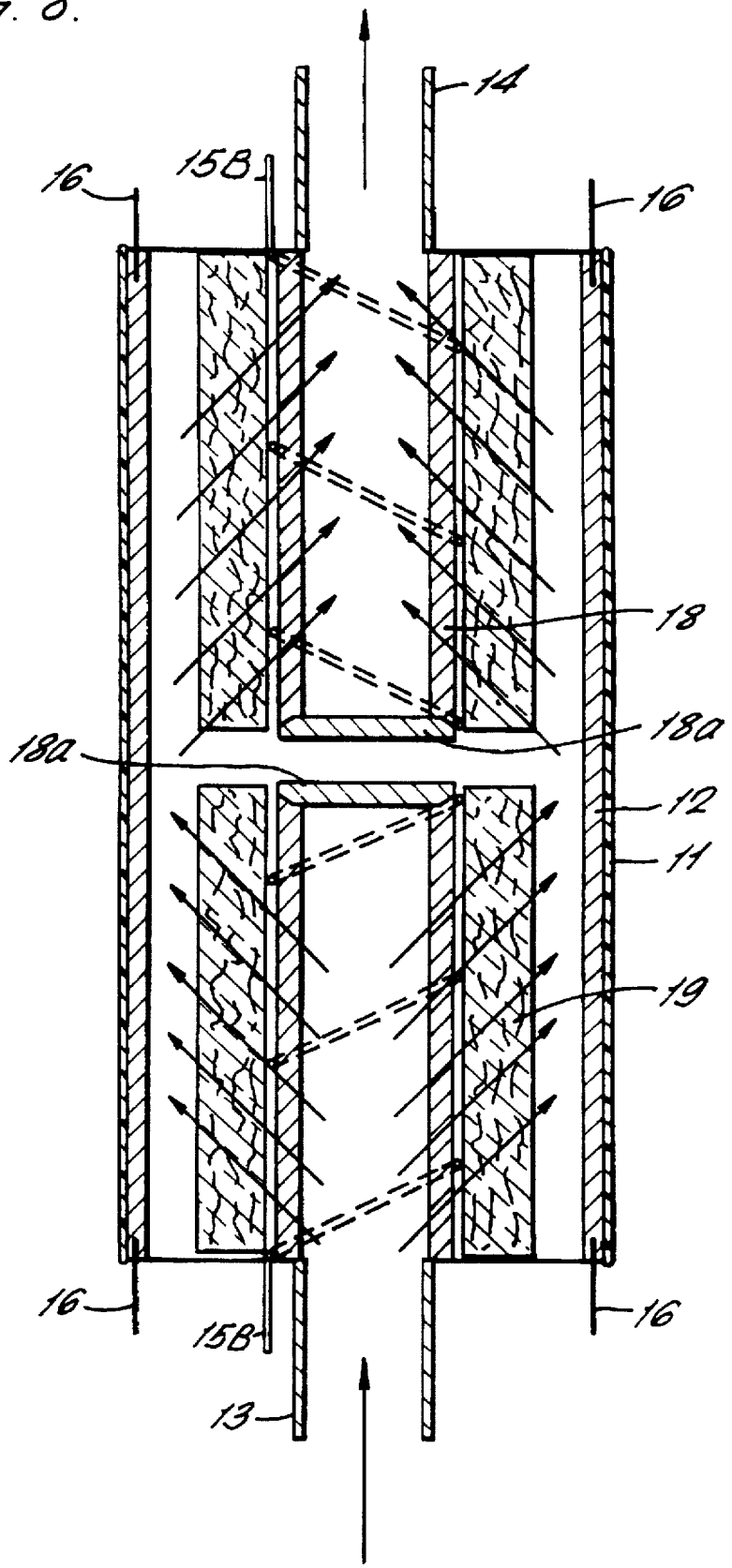
FIG. 8 is a sectional view similar to FIG. 3 showing a spiral current feeder.
Figure 9:
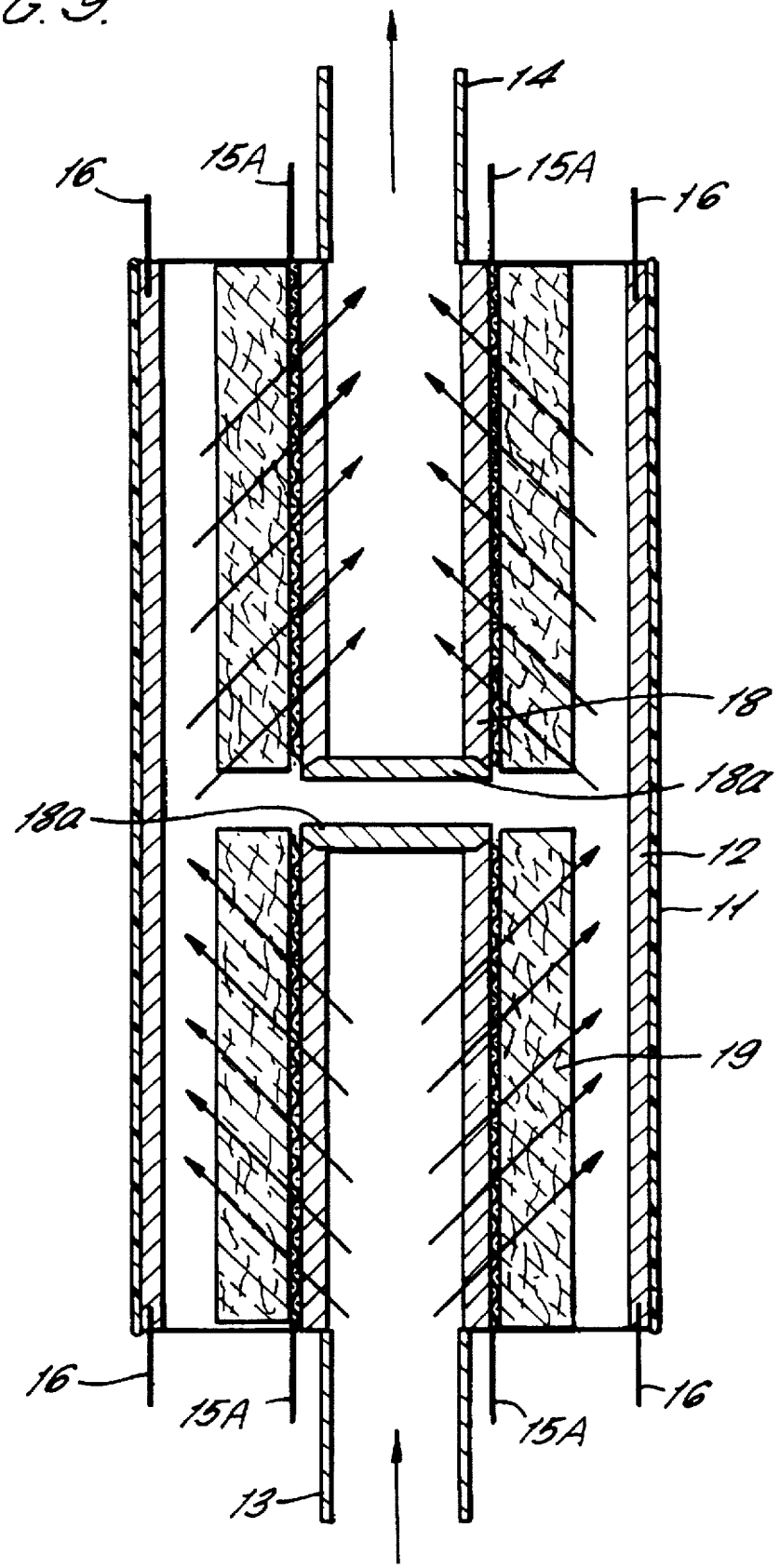
FIG. 9 is a sectional view similar to FIG. 3 showing a mesh current feeder.

As a result of the metal feeders running along the entire length of the cathode 19, a very even distribution of electrode potential is normally obtained. Accordingly, there is very little variation in the rate of metal deposition along the cathode length and circumference and a very high percentage of the surface area is active. The current efficiency for metal electro-deposition therefore can be maximised. The result is that there are no discrete areas operating at relatively high cathode potentials and this minimises the formation of excessive quantities of hydrogen. No discrete areas are operating at relatively low cathode potentials below the threshold required for metal deposition. The even distribution of the metal deposited enables a high total metal loading to be achieved before it is necessary to change the cathode cartridge. This reduces the frequency with which cathode cartridges require changing. The likelihood of dendritic growth of the metal deposit from the cathode towards the anode is low, thereby reducing the probability of electrical shorting. In certain circumstances it is desirable to improve the distribution of electrode potential by including more than two current feeders along the length of the cathode or by incorporating mesh current feeders 15A, as shown in FIG. 9, or a spiral current feeder 15B, as shown in FIG. 8, both of which forms of current feeders extend along the length of the cathode, as disclosed by rod current feeders 15.

The cell is also provided with current feeders 16 which also extend outside the end plate assemblies. Rods 16 are connected to the anodes and provide a means of supplying current to the anode assembly.

Figure 3:
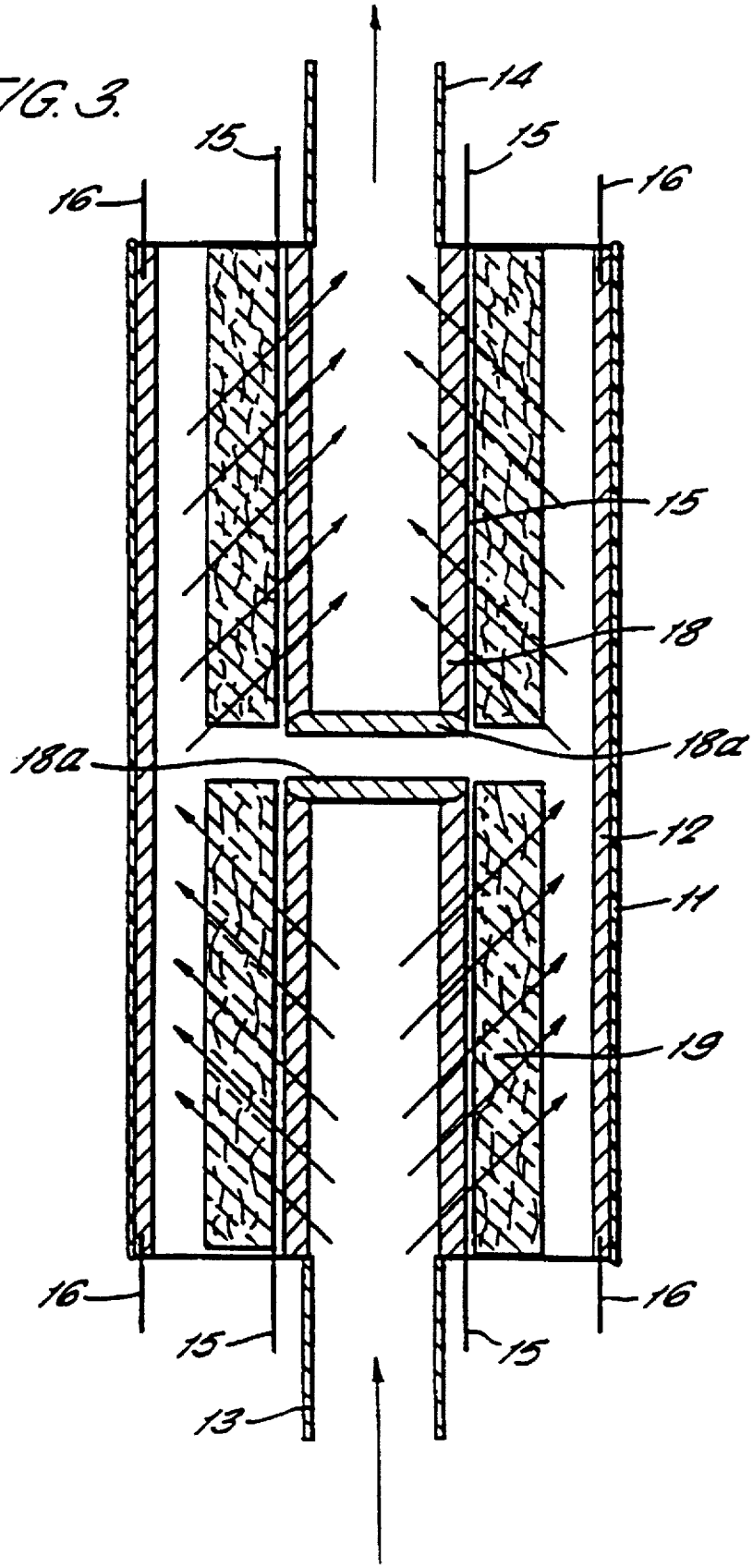
FIG. 3 shows a vertical cross-section of an embodiment of the invention with two cathodes in line in the electrolyte flow path.

Concentric with the anode 12 and located in the centre of the tube 11 is at least one porous polyethylene support tube or thimble 18 which is closed at one end by closure 18*a*(see FIG. 3). The polyethylene thimble 18 is held and located in a recessed hole (not shown) located at the centre of the upper end plate assembly 17. The recessed hole is slightly, undersized with respect to the diameter of the polyethylene thimble so that it can be held by a pressfit.

The end plates 17 are either bolted to a flange (not shown) welded to the end of the tube 11, or alternatively, if thick-walled tube is used, the end plate may simply be held against the end face using for example toggle clamps. Direct contact of the electrical connection with the electrolyte is prevented because the electrical connection is made outside of the end plate assembly; the electrolyte cannot pass through the end plate assembly since this is a liquid tight seal, and it cannot pass up the rod by capillary action since this is not porous. This avoids the problem of "wicking" and hence corrosion of the electrical connections by the electrolyte which is seen in prior art arrangements when the carbon fibers of the electrode, by capillary action, bring the electrolyte into contact with the terminals.

A liquid tight seal is provided to the cell by suitable chemically inert rubber O-rings located in a groove (not shown) provided in the end face of the tube 11 or in the case of a flanged pipe in the face of the flange.

The inlet 13 is provided centrally in end plate 17 so that solution can enter the cell via the porous polyethylene tube 18.

The cathode 19 is a carbon fiber felt which is sized in length and cut according to the length of the thimble 18 and in width according to its circumference.

The felt is wrapped around the thimble enclosing the metallic current feeders 15 and is located by a plastic encasing mesh 20. Other suitable fastenings may be employed, e.g. plastic ties. The carbon felt is secured tightly enough so as to ensure good electrical contact with the current feeders. Carbon felt can be obtained with a range of densities suitable for use as a cathode in the cell, depending on the nature of the metal to be deposited. Felts of different densities will provide different pressure drops as the electrolyte flows through the electrode and hence different flow regulation.

The thimble is withdrawn from the cell by undoing the end fastenings. A piece of the carbon felt is cut to size from a large roll and wrapped around the thimble securing it with the fastening. The thimble is then re-installed in the cell assembly, the feed tubes are connected, solution is pumped through the cell and current is applied. At the end of the required period current is switched off, pumping is halted and the thimble is removed as before. The carbon felt, laden with metal, is then removed and replaced with another piece in the manner already described. The metal laden felt can then be treated using anodic dissolution of the metal or by leaching into acid for electrowinning or it can be sent for pyrometallurgical treatment to reclaim the pure metal. At no stage is any degree of maintenance skill required.

In the embodiment as shown in FIG. 3 a second polyethylene thimble is used. In FIG. 3 the numerals indicate like parts as those of FIGS. 1 and 2. The second thimble enables the solution to exit the cell. A series of like thimbles and cathodes may be incorporated into the cell design depending on the application. Cells according to the invention may be employed in parallel operation. Preferably the construction of the cell exit end plate assembly is identical to the inlet end plate assembly thus allowing full interchangeability between the two.

If more than one of the thimbles are used in a cell then solution can flow through the carbon fiber mat from either cathode side to anode side or vice versa. The flow situation can be modified by blanking a portion of the thimble towards the top. Electrolyte flow is then forced through the available pores at the bottom of the thimble and surrounding carbon felt and past the remaining carbon felt at the top of the thimble. Further, as aforementioned, reversal of flow through a single cathode can be achieved by using a single thimble with its pores blocked at certain points.

Figure 4:
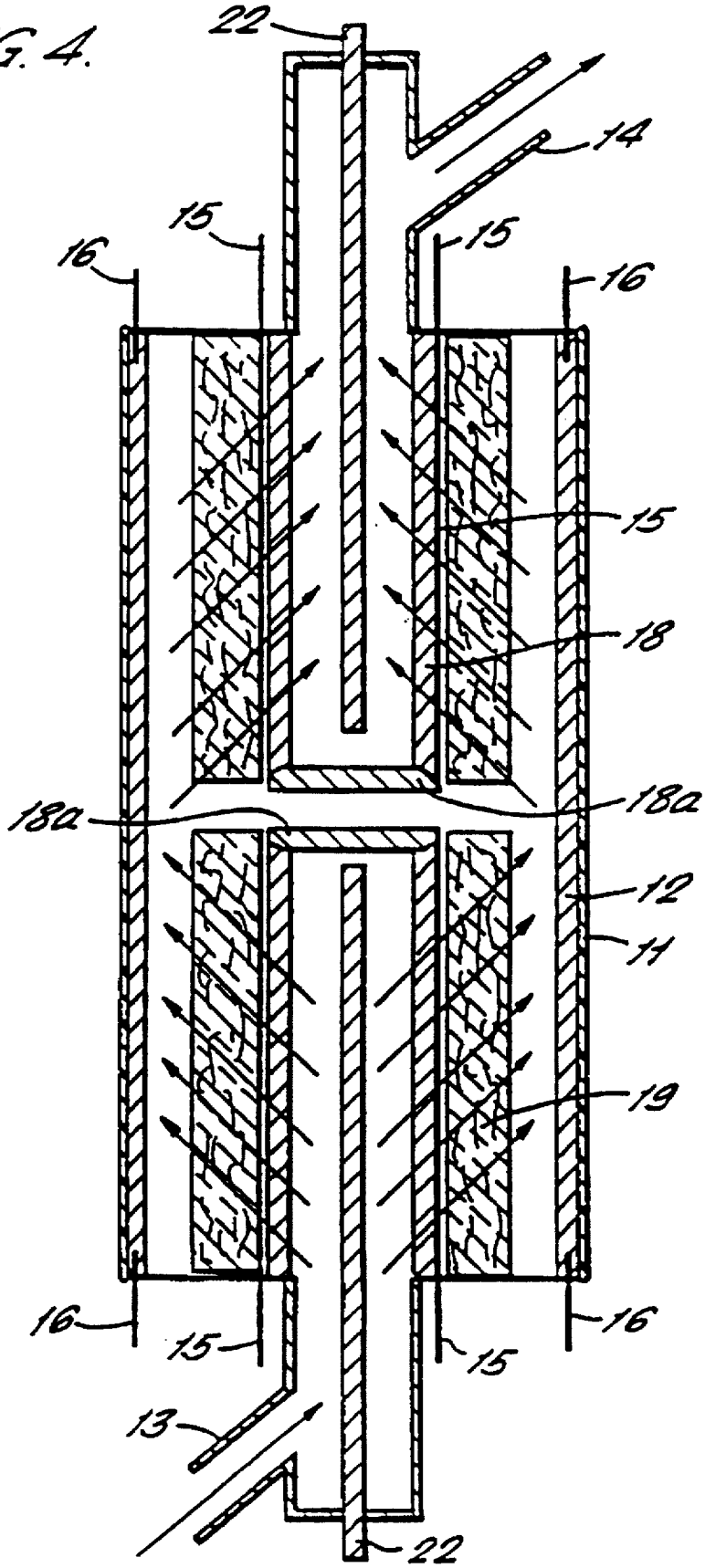
FIG. 4 shows a vertical cross-section of an embodiment of the invention in which at least one additional anode is located within the cathode support structure.

FIG. 4 shows another embodiment of the invention which is of similar construction to that shown in FIG. 3 but it includes a second anode 22, disposed in the central annulus of the porous support 18 but spaced therefrom. Since, in some applications, the metal may tend to deposit preferentially in the area of the carbon cathode 19 which is nearest the anode, the presence of a second anode on the other side of the cathode to the first anode 12 ensures more even metal deposition throughout the cathode. The second anode 22 is advantageously made in the form of a mesh in order that further pressure drops in the flow through the cell are avoided. Further, in this embodiment, in order that the second anode 22 is adequately protected by the outer casing 11 the inlets and outlets 13 and 14 are not disposed centrally as with some other embodiments.

Figure 5:
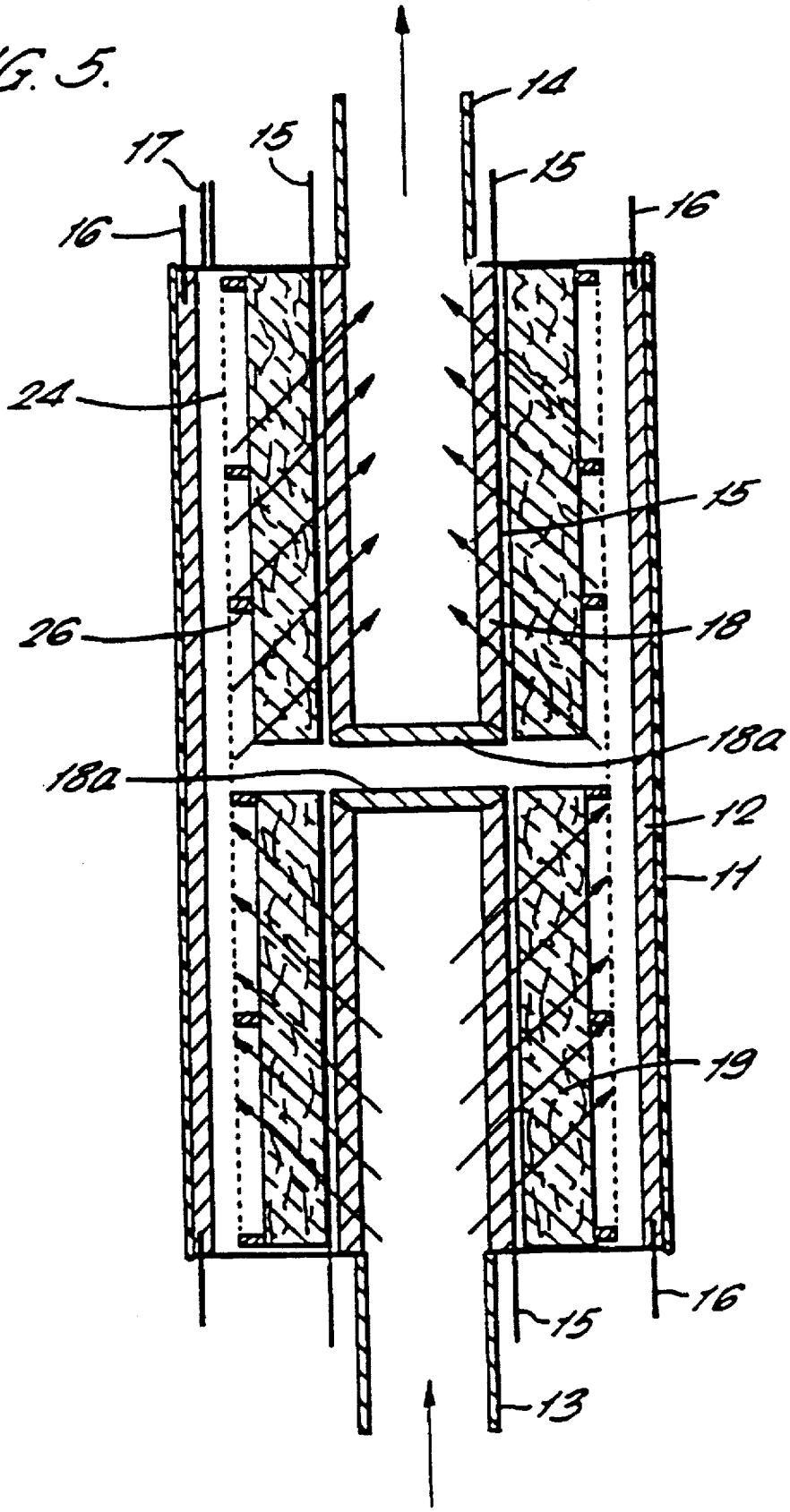
FIG. 5 shows a vertical cross-section of an embodiment of the invention including a microporous separator between the cathode and the anode.
Figure 6:
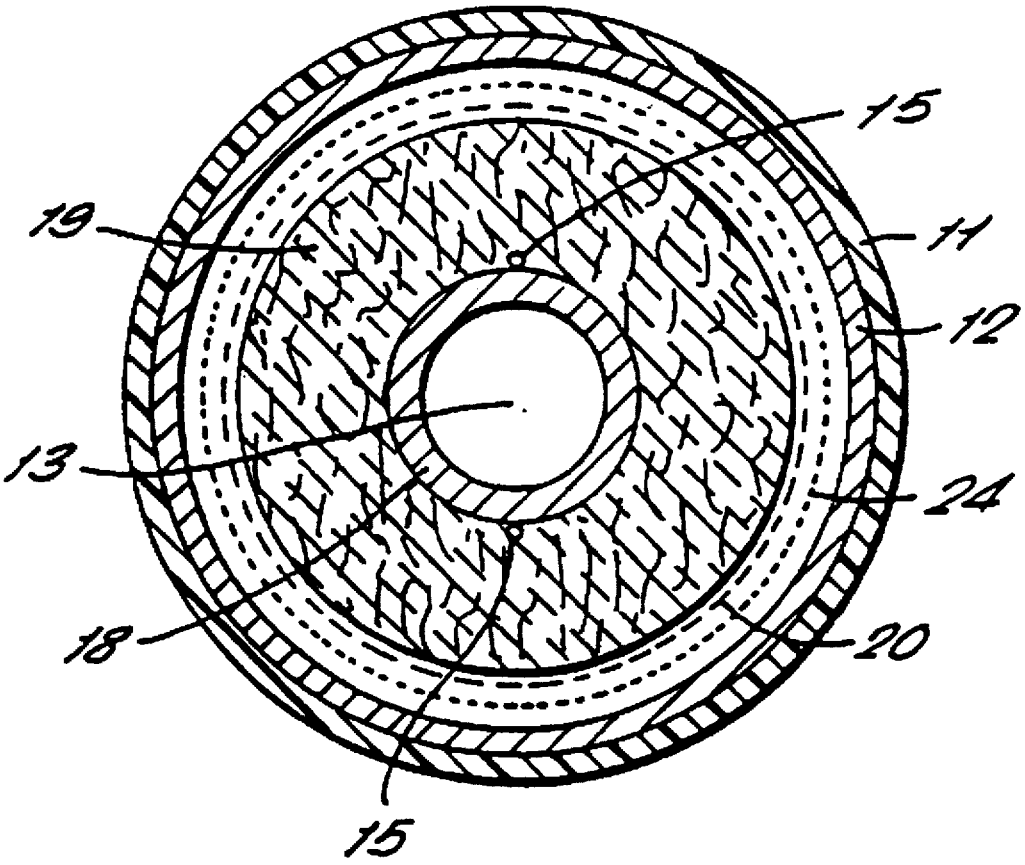
FIG. 6 shows a horizontal cross-section of the embodiment of FIG. 5.

FIGS. 5 and 6 show another embodiment of the invention with a similar construction to that shown in FIG. 3 but it includes an annular microporous separator 24 which is a polymer mesh tube, between the anode 12 and the carbon felt cathode 19. The separator is supported so as to be spaced off the cathode by a series of annular supports 26. A cell assembly including a microporous separator is shown in horizontal cross-section in FIG. 6. The separator 24 has a pore size of less than 20 microns and is therefore able to minimise passage of gases, and in particular prevent the mixing of hydrogen and oxygen which, in some applications, may be generated at the cathode and anode respectively. A bleed pipe 17 for the oxygen generated at the anode is provided in the top plate of the cell assembly (see FIG. 5).

Figure 7:
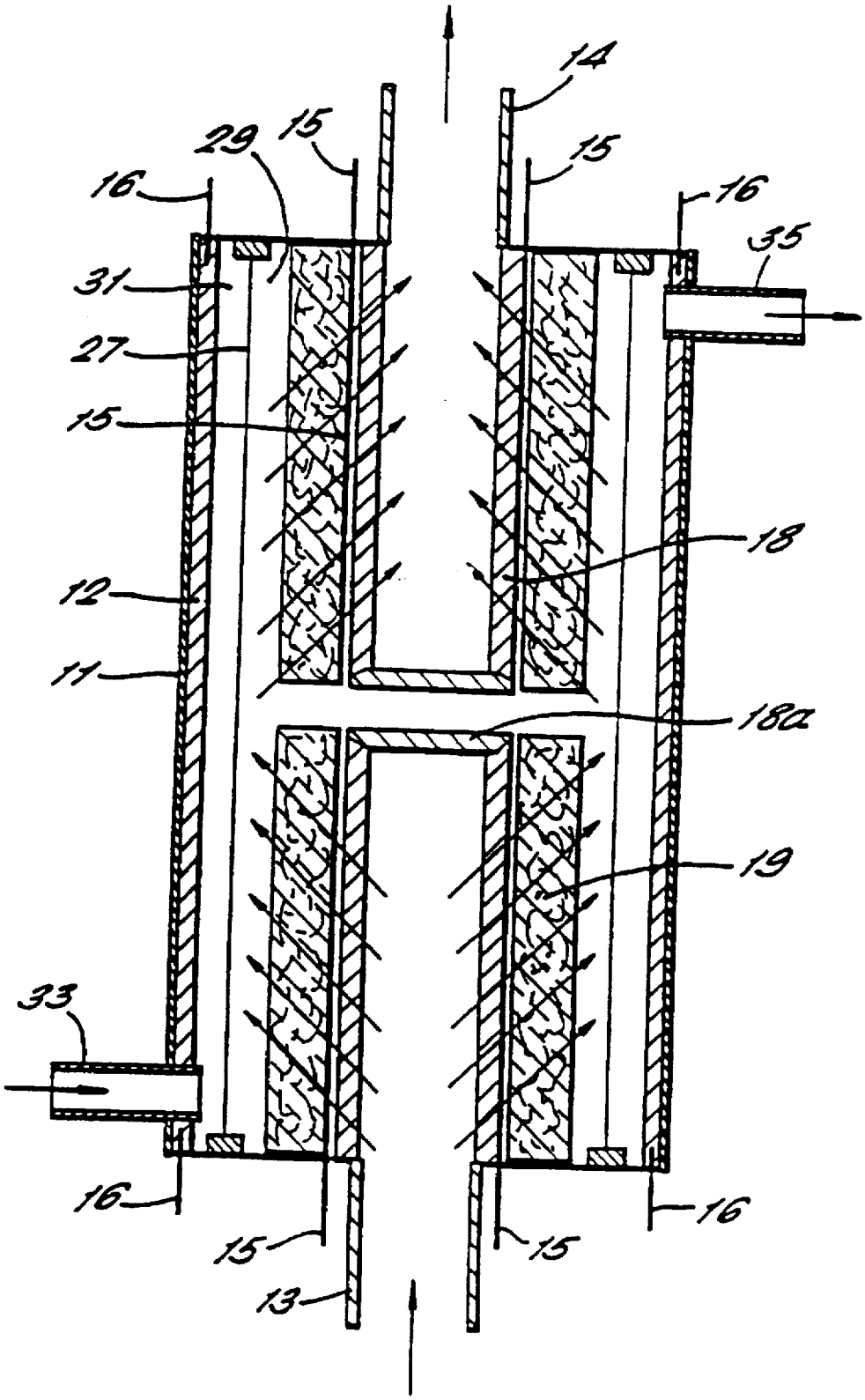
FIG. 7 shows a vertical cross-section of an embodiment of the invention including an ion-exchange membrane between the cathode and the anode.

FIG. 7 shows yet another embodiment of the invention in which a tubular ion-exchange membrane 27 is included between the anode and the cathode. The ion-exchange membrane effectively creates two compartments within the cell, one for the cathode 29 and one for the anode 31. The dilute solution from which metal is to be removed forms the catholyte and flows from the inlet 13 to the outlet 14 through the porous carbon felt cathode 19. A separate anolyte solution is introduced into the anode compartment 31 and flows from inlet 33 past the anode 12 to the outlet 35 in the same direction as the catholyte. The inclusion of an ion-exchange membrane is useful where the composition of the dilute solution to be treated results in the formation of a undesirable product at the anode. For example, when the solution to be treated contains chloride ions, chlorine will be produced at the anode which is not only a safety hazard but also may result in redissolution of the metal electrodeposit. The presence of the ion-exchange membrane effectively prevents the passage of chloride or other ions from the catholyte, which is the solution to be treated, to the separate anolyte solution. Contact of these ions with the anode is thereby avoided.

When the cells of the invention are in use the metal is deposited on the surface of the carbon fibers such that it extends into the body of the carbon felt. When extensive electrolysis of copper containing solutions have been carried out the appearance of the felt is that of a copper tube with deposition having occurred throughout the body of the cathode.

When the metal bearing capacity of the cathode is reached several options exist. The cell can be opened up, the carbon fiber mat removed and the deposited metals leached from it or it can be sent for smelting to recover the deposited copper. As an alternative, the metals can be anodically dissolved and the concentrated solution recovered electrolytically. When the cathode is removed a new piece of carbon felt is placed around the thimble in the same manner as before.

As will be well understood by those skilled in the art, the cell in use is integrated into plant by means of conventional pumps and tanks. Metal removal can be achieved by either recirculation of the electrolyte through the cell at a variety of flow rates and current densities; or in a single pass through the cell from holding tanks to discharge pipe. The mode of operation will be determined by the nature of the metal to be deposited and any process constraints.

Figure 10:
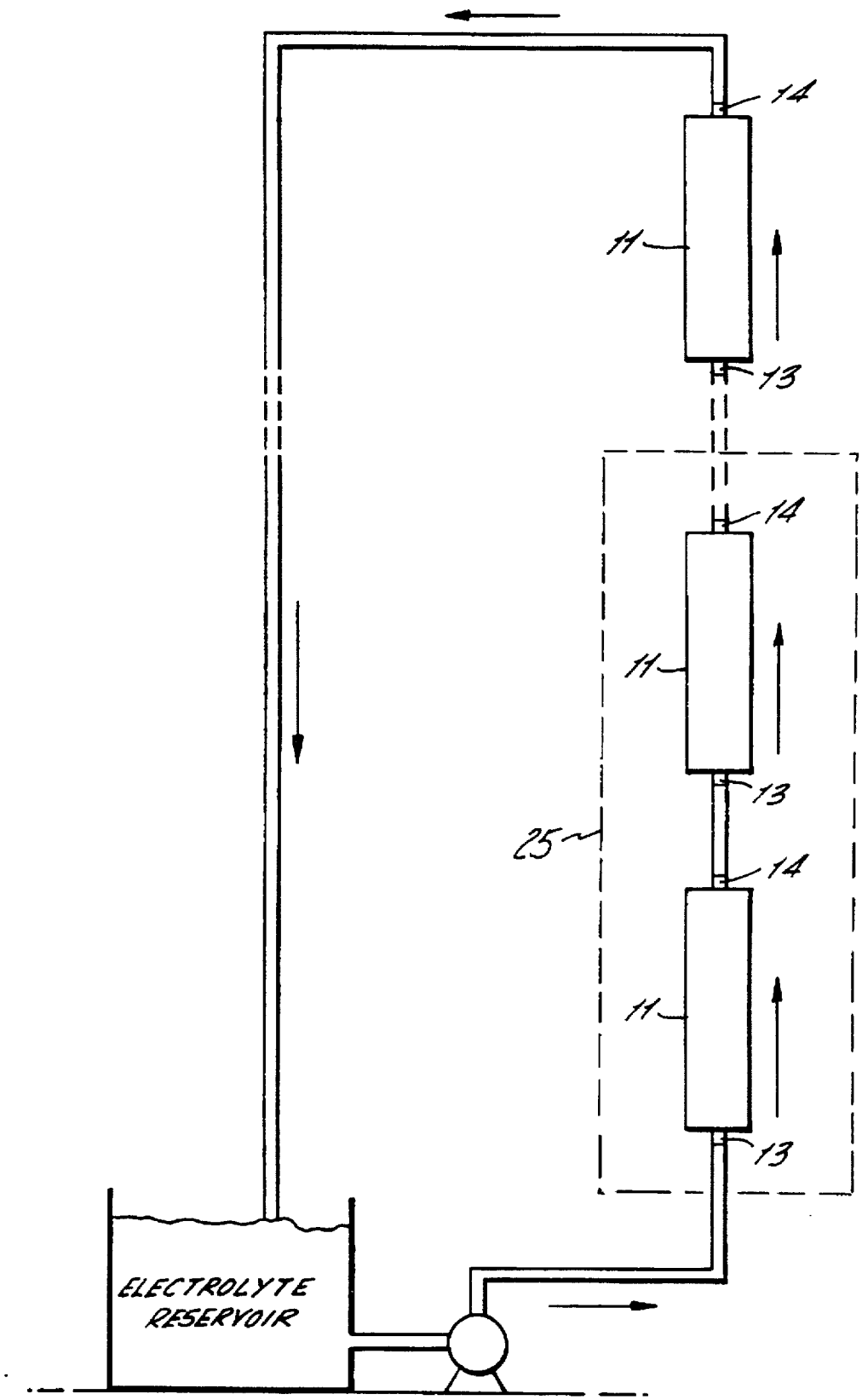
FIG. 10 is a schematic representation of a plurality of the electrodeposition cell tubes connected in series.
Figure 11:
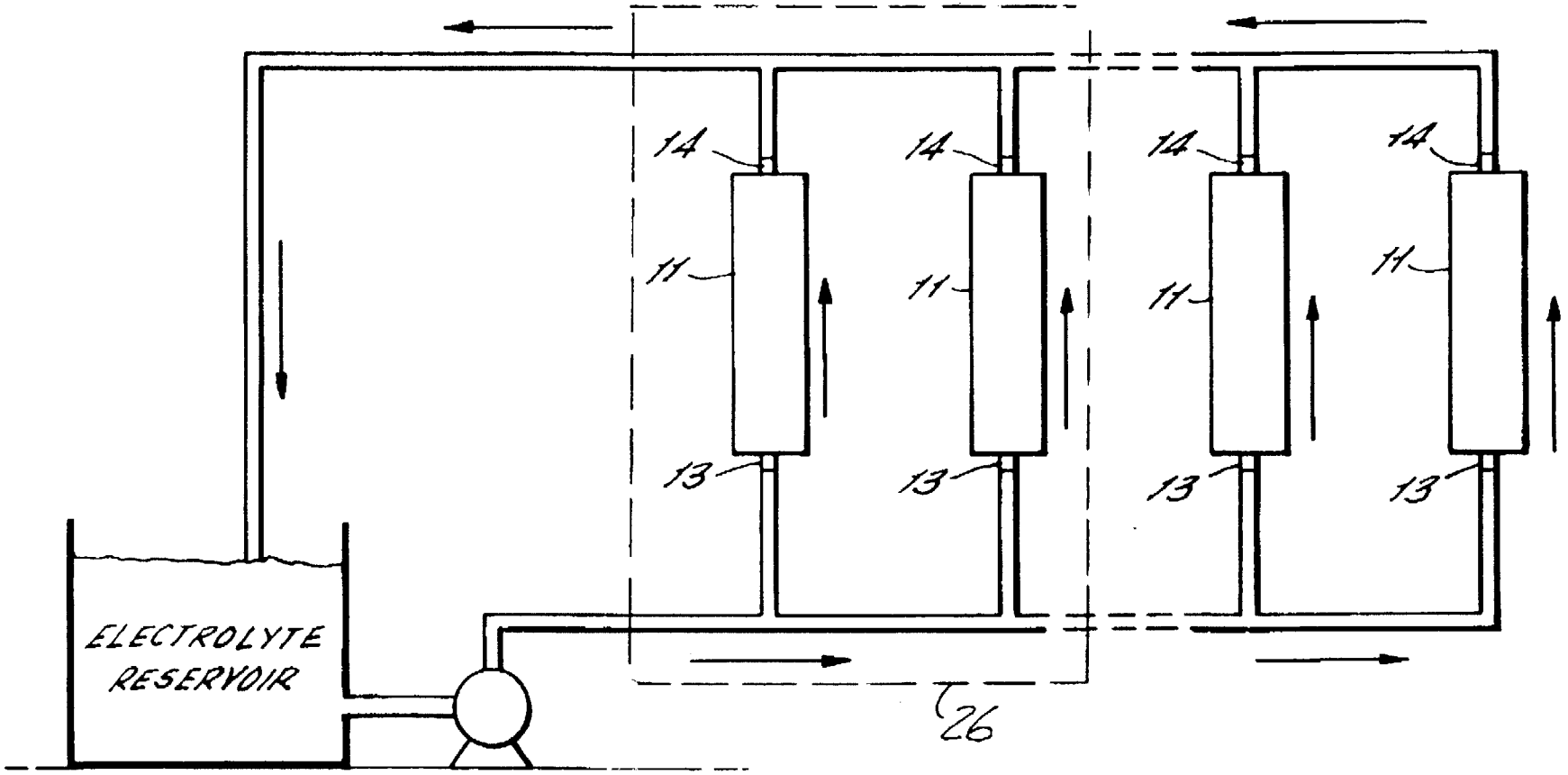
FIG. 11 is a plurality of electrodepositon tubes shown connected in parallel.

Individual cell modules are suited to flexible operation in combination, i.e. employing fluid flow in series as shown in FIG. 10 and/or in parallel as shown in FIG. 11. As shown in FIG. 10, two of the series connected electrolyte cells can be mounted in a single housing 25 represented in dotted lines, and as shown in FIG. 12, at least two of the electrolyte cells connected in parallel can be mounted in a common housing shown at 26 in dotted lines. The conventional pump and electrolyte tank mentioned above are also shown in FIGS. 10 and 11.

The bulk of the current is carried by a supporting electrolyte such as an acid, alkali or a neutral salt. When very low conductivity electrolytes are used the supporting electrolyte is added to the metal bearing waste and reduces the cell voltage to a suitable level.

In some instances it may be necessary to raise the temperature of the electrolyte or to add buffering agents such as boric acid to enhance deposition of certain metals. For some metal bearing wastes it may be necessary to deposit a layer of a suitable metal on the surface of the cathode prior to treatment of the waste. This initial layer may act as a precursor to deposition of the metal of interest and it can be deposited either by dosing small amounts of the precursor into the waste during electrolysis or by electrolysing a solution containing the metal prior to electrolysing the waste or by electroless deposition. Control of the pH in the feed tank of a recirculating electrolyte is important to avoid precipitation of the metal. The solutions which would be most suitable for treatment using the cell as described above fall broadly into two categories; those where there is a need to comply with local consent limits for discharge of metal bearing effluents, and these are often toxic and environmentally damaging metals; and those where there is an intrinsic metal value which would cause a financial loss if the metal was not recovered. Often these solutions have already undergone some conventional chemical treatment such as precipitation or ion exchange but there remains a metal content which, for the reasons listed above, needs to be treated.

The invention will now be further illustrated by the following examples.

EXAMPLE 1

50 litres of an industrial effluent containing 26 ppm copper were placed in a holding tank for the cell. Sodium sulphate was added to the tank to give a final concentration of 0.05M. The electrolyte, at ambient temperature and pH 3, was recirculated through the high surface area cell shown in FIG. 3 at a flow rate of 20 litres/minute. A current density of 200 $A/m^2$ (based on geometric area) was applied. Samples taken before and during the electrolysis showed that the copper concentration was reduced to <1 ppm in 90 minutes.

EXAMPLE 2

50 litres of an industrial effluent containing 10.7 ppm copper were placed in a holding tank for the cell. Sodium sulphate was added to the tank to give a final concentration of 0.05M. The electrolyte, at ambient temperature and pH 3, was recirculated through the high surface area cell shown in FIG. 3 at a flow rate of 20 litres/minute. A current density of 200 $A/m^2$ (based on geometric area) was applied. Samples taken before and during the electrolysis showed that the copper concentration was reduced to <1 ppm in 15 minutes.

EXAMPLE 3

5 litres of another industrial effluent containing tellurium, platinum, iridium, copper, silver and palladium in the concentrations indicated below were electrolysed for one hour in the cell shown in FIG. 3 using a current density of 200 $A/m^2$ (based on geometric area). The pH and temperature of the system were not adjusted. The concentrations of the metals were reduced to the levels shown below in one hour. The flow rate was 20 litres/minute.

| | Initial concentration (ppm) | Final concentration (ppm) |
|---|---|---|
| Te | 7.09 | <0.1 |
| Pt | 32.5 | 0.5 |
| Ir | 5.8 | 2.5 |
| Cu | 23.0 | 0.5 |
| Ag | 4.0 | <0.1 |
| Pd | 16.8 | <0.1 |

EXAMPLE 4

100 litres of a solution containing 28 ppm silver in a 0.1M $NaNO_3$ solution were electrolysed in the cell shown in FIG. 3 under conditions of ambient temperature and pH 3, and at a current density of 200 $A/m^2$ (based on geometric area). The silver concentration was reduced from 28 ppm to 0.2 ppm in 30 minutes.

EXAMPLE 5

100 litres of a solution containing 22.2 ppm nickel in a 0.1M $Na_2SO_4$ matrix were electrolysed in the cell under conditions at 40° Celsius and pH 3.5–4 and a current density of 200 $A/m^2$ (based on geometric area). The nickel concentration was reduced from 22.2 ppm to 7.2 in 120 minutes.

EXAMPLE 6

100 litres of a solution containing 19 ppm nickel in a 0.1M $Na_2SO_4$ matrix were electrolysed in the cell under conditions at 40° Celsius and pH 4 and using a current density of 200 $A/m^2$ (based on geometric area). The nickel concentration was reduced from 19 ppm to 5 ppm in 120 minutes. Conditions in this example were identical to those in example 6 with the addition of 4 g/l boric acid.

In an experiment to examine the feasibility of removing the electrodeposited copper from a felt cathode a stripping cell was utilised. The counter electrode (the cathode) in the copper stripping cell was copper tube which was concentric with the felt electrode which remained in the centre of the cell. In the stripping cell the copper loaded felt was made the anode. Current was passed through the cell and substantially all the deposited copper was then transferred to the copper tube cathode.

From the above examples, it will be seen that satisfactory flow is 20 litres/minute, and preferred rates are from 15 to 25 litres per minute. Also, the current density employed is preferably from 100 to 300 $A/m^2$.

We claim:

1. An electrochemical cell for the removal of at least one metal from dilute solutions of the metal, said cell comprising a porous tubular support which is provided with a cathode comprising a porous carbon fiber material, a current feeder for the cathode, a tubular anode spaced from said cathode, a current feeder for the anode, the anode and cathode being enclosed by a non-porous outer casing, the arrangement being such that in use during electrolysis the dilute solution from which the metal is to be removed is introduced into the cell by means of an inlet and flows through the porous carbon fiber cathode and out from the cell through an outlet wherein said current feeder for the cathode is supported on said porous tubular support and said feeder extends along the entire length of said cathode.

2. A cell as claimed in claim 1, wherein the cathode is a carbon felt which is wrapped around the said porous support with at least one complete winding around the support.

3. A cell as claimed in claim 1, wherein the outer casing provides a support for the tubular anode which extends for substantially the full length of the tube.

4. A cell as claimed in claim 1, wherein the anode (12) is made of one of the group consisting of nickel, noble metal coated titanium stainless steel and mild steel.

5. A cell as claimed in claim 1, wherein there are provided at least two cathodes arranged in series in the flow path, the arrangement being such that when in use the solution passes into the cell from the inlet, through the first cathode in a direction towards the anode, and then through the second cathode in the opposite direction towards the outlet.

6. A cell as claimed in claim 1, which includes a single cathode wherein means are provided to direct the flow of the solution through said cathode towards and away from the anode at different points along the cathode.

7. A cell as claimed in claim 1, wherein there is provided an additional anode disposed within the tubular porous support and spaced therefrom.

8. A cell as claimed in claim 1, wherein there is provided a microporous separator between the cathode and the anode.

9. A cell as claimed in claim 1, wherein there is provided an ion-exchange membrane between the cathode and the anode.

10. An apparatus for the removal of at least one metal from dilute solutions of said metal which comprises at least two cells as claimed in claim 1 arranged in a flow path selected from the group consisting of a series flow path and a parallel flow path.

11. An apparatus as claimed in claim 10 wherein the at least two cells are in a single housing.

12. A cell as claimed in claim 1, wherein said porous tubular support is of a non-electrically conducting material.

13. A cell as claimed in claim 1, wherein the current feeder for the cathode is selected from the group consisting of a strip and a rod.

14. A cell as claimed in claim 1, wherein said current feeder for the cathode is selected from the group consisting of a spiral and a mesh.

15. An apparatus for the removal of at least one metal from dilute solutions of said metal which comprises at least two cells as claimed in claim 14 arranged in at least one of the flow paths selected from the group consisting of a series flow path and a parallel flow path.

16. An apparatus as claimed in claim 15, wherein the at least two cells are in a single housing.

17. A cell as claimed in claim 1, wherein said current feeder for the cathode comprises a metal of lower electrical resistance than said porous carbon fiber cathode.

18. A method of removing at least one metal from a dilute solution, which method comprises passing a dilute solution of the said metal through an electrolytic cell, which cell comprises a porous tubular support which is provided with a cathode comprising a porous carbon fiber material, a current feeder for the cathode which feeder is supported on said porous tubular support and extends along the entire length of said cathode, a tubular anode spaced from said cathode and a current feeder for the anode, the anode and cathode being enclosed by a non-porous outer casing, wherein the passing comprises introducing said dilute solution from which said at least one metal is to be removed into said cell by means of an inlet so said diluted solution flows through the porous carbon fiber cathode and out from the cell through an outlet.

19. A method as claimed in claim 18, wherein the dilute solution has a concentration of depositable metal ions, of less than 50 ppm.

20. The method as claimed in claim 13, wherein the concentration of depositable metal ions is no greater than 20 ppm.

21. A method as claimed in claim 18, wherein the dilute solution flows through the electrochemical cell at a rate from about 2 to about 80 litres/minute.

22. A method as claimed in claim 21 wherein the flow rate of the dilute solution is from about 15 to about 30 litres/minute.

23. A method as claimed in claim 18, wherein a current is provided between the anode and cathode having a current density during the removal of the metal from the dilute solution from about 100 to about 300 $A/m^2$.

24. A method as claimed in claim 18, wherein a current is provided between the anode and the cathode having a current density during the removal of the metal from the dilute solution between about 300 and about 800 $A/m^2$.

25. A method as claimed in claim 18, wherein said at least one metal is selected from the group consisting of copper, lead, silver, tellurium, platinum, palladium and nickel.

26. An electrochemical cell for the removal of at least one metal from dilute solutions of the metal, said cell comprising a porous tubular support of a non-electrically conducting material, which is provided with a cathode comprising a porous carbon fiber material, a current feeder for the cathode, a tubular anode spaced from said cathode, a current feeder for the anode, the anode and cathode being enclosed by a non-porous outer casing, the arrangement being such that in use during electrolysis the dilute solution from which the metal is to be removed is introduced into the cell by means of an inlet and flows through the porous carbon fiber cathode and out from the cell through an outlet, wherein said current feeder for the cathode is supported on said non-conducting porous tubular support and said current feeder extends along the entire length of said cathode.

27. A cell as claimed in claim 26, wherein the current feeder for the cathode is selected from the group consisting of a rod and a strip.

28. A cell as claimed in claim 26, wherein the current feeder for the cathode is selected from the group consisting of a spiral and a mesh.

29. A cell as claimed in claim 26, wherein said current feeder for the cathode comprises a metal of lower electrical resistance than said porous carbon fiber cathode.

30. A cell as claimed in claim 26, wherein the cathode is a carbon felt which is wrapped around the said porous support with at least one complete winding around the support.

31. A cell as claimed in claim 26, wherein the outer casing provides a support for the tubular anode which extends for substantially the full length of the tube.

32. A cell as claimed in claim 26, wherein the anode is selected from the group consisting of a nickel anode, a noble metal coated titanium anode, a stainless steel anode and a mild steel anode.

33. A cell as claimed in claim 26, wherein there are provided at least two cathodes arranged in series in the flow path, the arrangement being such that when in use the solution passes into the cell from the inlet through the first cathode in a direction towards the anode, and then through the second cathode in the opposite direction towards the outlet.

34. A cell as claimed in claim 26, which includes a single cathode wherein means are provided to direct the flow of the solution through said cathode towards and away from the anode at different points along the cathode.

35. A cell as claimed in claim 26, wherein there is provided an additional anode disposed within the tubular porous support and spaced therefrom.

36. A cell as claimed in claim 26, wherein there is provided a microporous separator between the cathode and the anode.

37. A cell as claimed in claim 26, wherein there is provided an ion-exchange membrane between the cathode and the anode.

38. A method of removing at least one metal from a dilute solution thereof which method comprises passing a dilute solution of said metal through an electrolytic cell, which cell comprises a porous tubular support of a non-electrically conducting material which is provided with a cathode comprising a porous carbon fiber material, a current feeder for the cathode, which feeder is supported on said porous tubular support and extends along the entire length of said cathode, a tubular anode spaced from said cathode and a current feeder for the anode, the anode and the cathode being enclosed by a non-porous outer casing, wherein the passing comprises introducing said dilute solution from which said at least one metal is to be removed into said cell by means of an inlet so said dilute solution flows through the porous carbon fiber cathode and out from the cell through an outlet.

39. A method as claimed in claim 38, wherein said at least one metal is selected from the group consisting of copper, lead, silver, tellurium, platinum, palladium and nickel.

40. A method as claimed in claim 38, wherein the concentration of the depositable metal ions is less than 50 ppm.

41. A method as claimed in claim 40, wherein the concentration of the depositable metal ions is 20 ppm.

42. A method as claimed in claim 38, wherein the flow rate of the dilute solution is from about 2 to about 80 liters/minute.

43. A method as claimed in claim 42, wherein the dilute solution flows through the porous carbon filter at a rate of from about 15 to about 30 liters/minute.

44. A method as claimed in claim 38, wherein a current is provided between the anode and the cathode having a current density during the removal of the metal from the dilute solution from about 100 to about 300 $A/m^2$.

45. A method as claimed in claim 38, wherein a current is provided between the anode and the cathode having a current density during the removal of the metal from the dilute solution between about 300 and about 800 $A/m^2$.

46. An electrochemical cell for the removal of at least one metal from dilute solutions of the metal, said cell comprising a porous tubular support of a non-electrically conducting material which is provided with a cathode comprising a porous carbon fiber material, a first current feeder for the cathode, a tubular anode spaced from said cathode, a second current feeder for the anode, the anode and cathode being enclosed by a non-porous outer casing, the arrangement being such that in use during electrolysis the dilute solution from which the metal is to be removed is introduced into the cell by means of an inlet and flows through the porous carbon fiber cathode and out from the cell through an outlet, wherein said first current feeder for the cathode is supported on said non-conducting porous tubular support and said first current feeder extends along the entire length of said cathode, and wherein an ion-exchange membrane is disposed between said anode and said cathode.

47. A cell as claimed in claim 46, wherein the current feeder for the cathode is selected from the group consisting of a strip and a rod.

48. A cell as claimed in claim 46, wherein the current feeder for the cathode is selected from the group consisting of a spiral and a mesh.

49. A cell as claimed in claim 46, wherein said current feeder for the cathode comprises a metal of lower electrical resistance than said porous carbon fiber cathode.

50. A cell as claimed in claim 46, wherein the cathode is a carbon felt which is wrapped around the said porous support with at least one complete winding around the support.

51. A cell as claimed in claim 46, wherein the outer casing provides a support for the anode which extends for substantially the full length of the outer casing.

52. A cell as claimed in claim 46, wherein the anode is selected from the group consisting of a nickel anode, a noble metal coated titanium anode, a stainless steel anode and a mild steel anode.

53. A cell as claimed in claim 46, wherein there are provided at least two cathodes arranged in series in the flow path, the arrangement being such that when in use the solution passes into the cell from the inlet through the first cathode in a direction towards the anode, and then through the second cathode in the opposite direction towards the outlet.

54. A cell as claimed in claim 46, which includes a single cathode wherein means are provided to direct the flow of the solution through said cathode towards and away from the anode at different points along the cathode.

55. A cell as claimed in claim 46, wherein there is provided an additional tubular anode disposed within the tubular porous support and spaced therefrom.

56. An apparatus for the removal of at least one metal from dilute solutions of said metal which comprises at least two cells as claimed in claim 46 arranged in a flow path selected from the group consisting of a series flow path and a parallel flow path.

57. An apparatus as claimed in claim 56, wherein the at least two cells are in a single housing.

58. A method of removing at least one metal from a dilute solution thereof which method comprises passing a dilute solution of said metal through an electrolytic cell, which cell comprises a porous tubular support of a non-electrically conducting material which is provided with a cathode comprising a porous carbon fiber material, a current feeder for the cathode, which feeder is supported on said porous tubular support and extends along the entire length of said cathode, a tubular anode spaced from said cathode and a current feeder for the anode, the anode and the cathode having interposed therebetween an ion exchange membrane and being enclosed by a non-porous outer casing wherein the passing comprises introducing said dilute solution from which said at least one metal is to be removed into said cell by means of an inlet so said dilute solution flows through the porous carbon fiber cathode and out from the cell through an outlet.

59. A method as claimed in claim 58, wherein said at least one metal is selected from the group consisting of copper, lead, silver, tellurium, platinum, palladium and nickel.

60. A method as claimed in claim 58, wherein the dilute solution has a concentration of depositable metal ions of less than 50 ppm.

61. A method as claimed in claim 58, wherein the dilute solution has a concentration of depositable metal ions of 20 ppm or less.

62. A method as claimed in claim 58, wherein the dilute solution flows through the porous carbon filter at a flow rate of from about 2 to about 80 liters/minute.

63. A method as claimed in claim 62, wherein the flow rate of the dilute solution is from about 15 to about 30 liters/minute.

64. A method as claimed in claim 58, wherein a current is provided between the anode and the cathode having a current density during the removal of the metal from the dilute solution from about 100 to about 300 $A/m^2$.

65. A method as claimed in claim 58, wherein a current is provided between the anode and the cathode having a current density during the removal of the metal from the dilute solution between about 300 and about 800 $A/m^2$.

* * * * *